US007975432B2

(12) United States Patent
Morton et al.

(10) Patent No.: US 7,975,432 B2
(45) Date of Patent: Jul. 12, 2011

(54) CASEMENT WINDOW ASSEMBLY WITH WINDLOAD AND IMPACT RESISTANCE

(75) Inventors: Jonathan G. Morton, Germantown, OH (US); Dennis D. Cox, Middletown, OH (US)

(73) Assignee: Deceuninck North America, LLC, Monroe, OH (US)

( * ) Notice: Subject to any disclaimer, the term of this patent is extended or adjusted under 35 U.S.C. 154(b) by 657 days.

(21) Appl. No.: 11/515,622

(22) Filed: Sep. 5, 2006

(65) Prior Publication Data

US 2008/0127566 A1 Jun. 5, 2008

(51) Int. Cl.
*E05D 15/28* (2006.01)

(52) U.S. Cl. ..... 49/246; 49/400; 49/401; 49/381

(58) Field of Classification Search ..... 49/246, 49/394, 395, 400, 401, 50, 61, 62, 63, 67, 49/260, 381; 52/204.5, 204.66
See application file for complete search history.

(56) References Cited

U.S. PATENT DOCUMENTS

| | | | | |
|---|---|---|---|---|
| 1,231,069 | A * | 6/1917 | Schaffert | 49/401 |
| 1,796,242 | A * | 3/1931 | Cooper | 49/401 |
| 1,814,936 | A * | 7/1931 | Kubelka | 49/401 |
| 1,859,491 | A * | 5/1932 | Baer | 49/182 |
| 3,520,084 | A * | 7/1970 | Gigante | 49/381 |
| 4,126,965 | A * | 11/1978 | Hoffmann | 49/398 |
| 4,894,902 | A | 1/1990 | Tucker | |
| 5,040,267 | A | 8/1991 | Dallmann | |
| 5,511,352 | A * | 4/1996 | Sholton | 52/306 |
| 5,737,874 | A * | 4/1998 | Sipos et al. | 49/67 |
| 5,742,978 | A * | 4/1998 | Vetter | 16/220 |
| 6,363,659 | B1 * | 4/2002 | Wang | 49/183 |
| 6,588,154 | B1 * | 7/2003 | Miller et al. | 49/401 |
| 6,826,871 | B2 | 12/2004 | Morton et al. | |
| 7,546,711 | B2 * | 6/2009 | Salzer | 52/204.5 |
| 2005/0102933 | A1 * | 5/2005 | Salzer | 52/204.5 |
| 2006/0112641 | A1 * | 6/2006 | Salzer | 49/67 |

* cited by examiner

*Primary Examiner* — Gregory J. Strimbu
(74) *Attorney, Agent, or Firm* — Jacox, Meckstroth & Jenkins

(57) ABSTRACT

A casement window assembly includes a rectangular sash frame enclosing an insulated glass panel unit and supported for swinging movement by a surrounding main window support frame. At least one set of interfitting and interlocking members are positioned in opposing relation on adjacent vertical members of the sash frame and support frame and have hook portions positioned to pass each other when the sash frame is pivoted between a closed position and an open position. The hook portions are effective to engage and hook each other in response to a substantial positive or negative windload or such windload applied after an impact breaks the glass to limit deflection and prevent permanent deformation of the sash frame. The hook portions also produce a snubbing action for compressing a flexible seal between the sash frame and support frame.

2 Claims, 2 Drawing Sheets

CASEMENT WINDOW ASSEMBLY WITH WINDLOAD AND IMPACT RESISTANCE

BACKGROUND OF THE INVENTION

In the art of window assemblies having main window frames and sash frames formed of extrusions of a plastics material or polyvinylchloride, commonly referred to as vinyl, it has been found desirable in some installations, especially in residential and commercial buildings near the ocean and Gulf coast, to provide for keeping the window assembly in tact during a high windload, for example, during a hurricane or tornado. For example, U.S. Pat. No. 6,826,871, which issued to the assignee of the present invention, discloses a double hung or single hung window unit constructed of vinyl extrusions and incorporating hook members on the sill and bottom sash member. The hook members engage in response to a high negative windload to limit deflection of the sash frame and thereby avoid permanent deformation and/or separation of the sash frame. It is also desirable to limit deflection of a movable sash frame or separation of the sash frame from the surrounding main frame when the window glazing and glass panel unit are subjected to a high negative or positive windload after impact by an object sufficient to break the glass panel unit, such as during a hurricane or tornado.

SUMMARY OF THE INVENTION

The present invention is directed to an improved casement window assembly including a main support frame surrounding a sash frame, with both frames formed of extrusions of plastics material or vinyl. The sash frame surrounds and supports a glass panel unit and is supported for swinging and pivotal movement within the main support frame between open and closed positions. A first hook member is secured to a reinforced vertical frame member of the sash frame, and a second hook member is secured to an adjacent reinforced vertical frame member of the main support frame and in opposing relation to the first hook member. The hook members are positioned to pass each other when the sash frame moves between its open and close position.

The first and second hook members are also constructed and positioned to engage each other in response to a deflection of the sash frame by a substantial windload against the window glass and sash frame while in the closed position or such windload after an impact sufficient to break the glass, to avoid permanent deformation of the sash frame and/or separation of the sash frame from the main frame. The hook members may also be constructed to respond to either below atmospheric negative air pressure or above atmospheric positive air pressure on the outer surfaces of the glass window panel and sash frame. The hook members may further provide for producing a snubbing action for compressing a resilient seal when the sash frame is moved to its closed position.

Other features and advantages of the invention will be apparent from the following description, the accompanying drawings and the appended claims.

DESCRIPTION OF ONE PREFERRED EMBODIMENT

Figure 1:
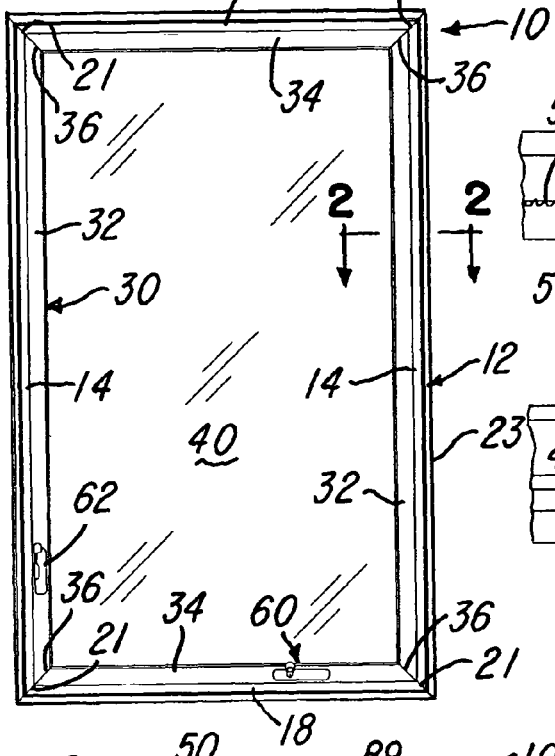
FIG. 1 is an elevational view of a closed casement window assembly constructed in accordance with the invention.
Figure 2:
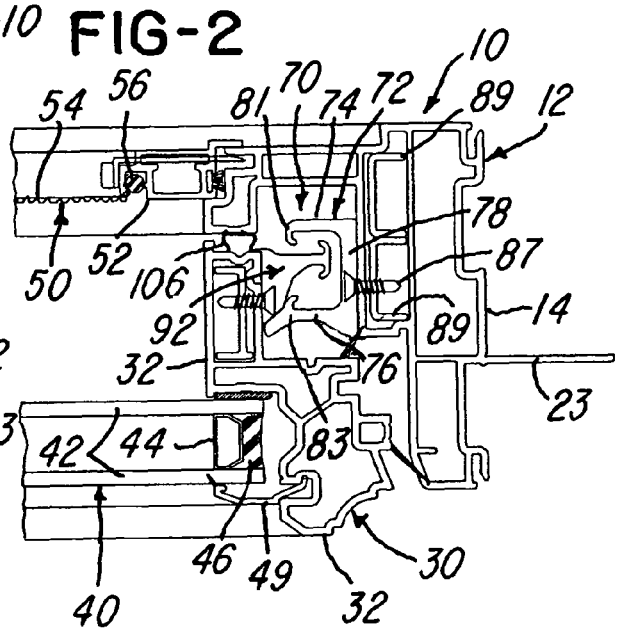
FIG. 2 is a fragmentary section of the window assembly in its closed position, taken generally on the line of the 2-2 of FIG. 1.

FIG. 1 illustrates a casement window assembly 10 which includes a rectangular main or outer support frame 12 constructed of horizontally spaced vertical frame members 14 and upper and lower horizontal frame members 18 each formed from an extrusion of plastics material or vinyl and having a cross-sectional configuration or profile as shown in FIG. 2. Preferably, the outer main frame members 14 and 18 have welded mitered corner joints 21 and laterally outwardly projecting nailing flanges 23 used to secure the outer support frame 12 within a rough opening of a building structure. The cross hatching for a plastics material and for metal and glass in FIGS. 2-8 has been omitted for purpose of clarity.

A rectangular sash frame 30 is supported within the outer support frame 12 and includes a pair of vertical stiles or frame members 32 and a pair of horizontal frame members 34 each formed from an extrusion of rigid plastics material or vinyl and having a cross-sectional configuration or profile as shown in FIG. 2. The sash frame members 32 and 34 also have welded mitered corner joints 36.

As also shown in FIG. 2, the casement sash frame 30 supports an insulated glass panel unit 40 constructed in a conventional manner with parallel spaced rectangular glass panes or panels 42 separated by a peripherally extending spacer member 44 and bonded together by a bonding material 46 such as a butye rubber. The glass panel unit 40 is retained within the sash frame 30 by peripherally extending linear glazing beads or members 49 also extruded of a plastics material. While the insulated glass panel unit 40 is illustrated with two glass panes or panels 42 for simplification, it is to be understood that the unit 40 may be constructed in other forms, for example, with three glass panels having two inner glass panels separated by a transparent inner layer of PVB, a construction or assembly commonly used to prevent the glass panels from shattering into pieces and separating when subjected to an impact causing the glass panels to crack. FIG. 2 also shows that the inner portion of the outer support frame 12 may support a removable screen unit 50 which includes a rectangular screen frame 52 and a flexible screen material 54 retained within the frame by a resilient bead 56, in a conventional manner.

Figure 3:
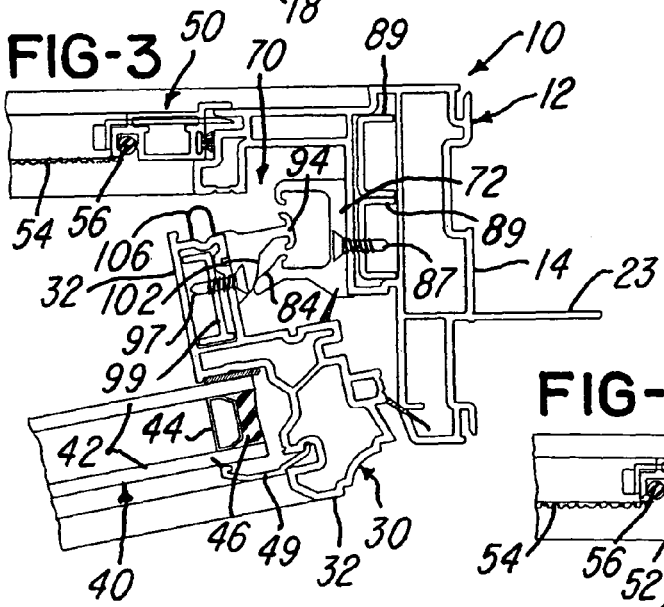
FIGS. 3-5 are fragmentary sections similar to FIG. 2 and showing the sash frame and glass window panel in different degrees of an open position.
Figure 4:
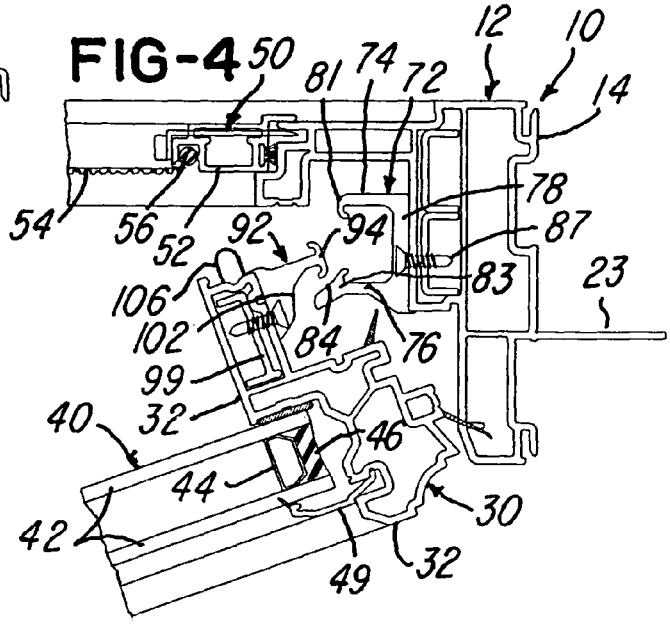
Figure 5:
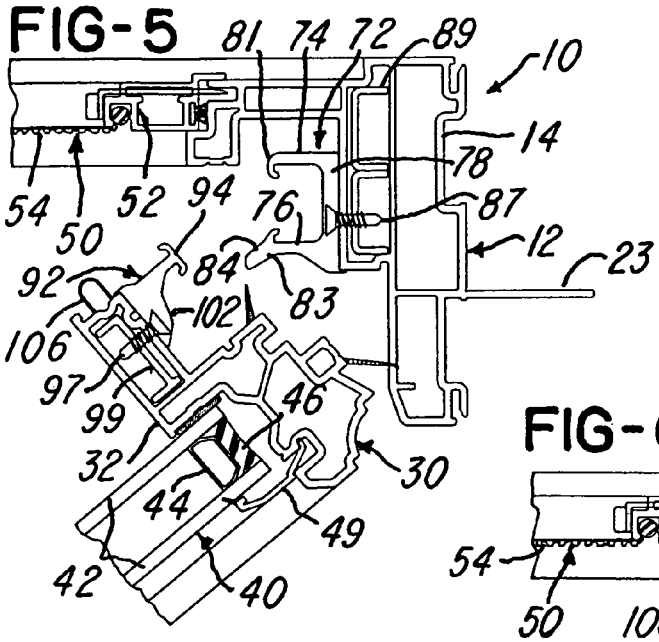

The sash frame 30 of the casement window assembly 10 is supported for pivotal and swinging movement relative to the main support frame 12 by conventional hardware, for example, hardware manufactured by Truth Incorporated in Owatonna, Minn. Their U.S. Pat. No. 5,040,267 discloses a hinge system for a casement window assembly, and the Company also manufactures a crank type operator mechanism 60 (FIG. 1), for example, as disclosed in U.S. Pat. No. 4,894,902. Truth Incorporated also produces a latch mechanism 62 for a casement window and which is effective to lock upper and lower portions of the sash frame member 32 to the adjacent vertical frame member 14 of the outer support frame 12. FIGS. 3-5 illustrate the opening of the sash frame 30 and glass unit 40 from the outer support frame 12 and from a closed position (FIG. 2) and an open position, with FIG. 3 showing a 10° open position, FIG. 4 showing a 20° open position, and FIG. 5 showing a 40° open position.

In accordance with the present invention, an interlock system 70 is provided on the hinge side of the casement window assembly 10 between the right vertical main frame member 14 and the right vertical sash frame member 32. The interlock system 70 includes a first hook member 72 having generally a channel or U-shaped cross-sectional configuration or profile and including a first leg portion 74 and a second leg portion 76 integrally connected by a base portion 78. The leg portion 74 has a hook-shaped tip portion 81, and the leg portion 76 has a hook-shaped tip portion 83 and also a cam surface 84. The hook member 72 is formed from a section of an extrusion of metal such as aluminum and has a predetermined length, for example, 1.5 inches. A pair of vertically spaced sheet metal screws 87 secure the base portion 78 of the hook member 72 to the adjacent vertical frame member 14 which encloses a pair of metal reinforcing members or channels 89 extending the full length or height of the vertical frame member 14.

The interlock system 70 also includes a hook member 92 which has a hook-shaped tip portion 94 with hook portions projecting in opposite directions to provide generally a T-shaped cross-sectional configuration. The base portion of the hook member 92 is secured by a pair of vertically spaced screws 97 to the vertical sash frame member 32 which encloses a metal or aluminum reinforcing channel 99 extending the full length or height of the sash frame member 32. The hook member 92 also has a cam surface 102 which is positioned to engage the cam surface 84 on the hook member 72 when the sash frame 30 moves from its approximately 10° open position (FIG. 3) to its fully closed position (FIG. 2). The cam surfaces 84 and 102 produce a snubbing action on the hinge side of the assembly for aiding in compressing a bulb-type resilient seal 106 mounted on the sash frame member 32 and engaging the outer frame member 12, as shown in FIG. 2. While only one set of interlocking hook members 72 and 92 are shown in the drawings, two or more vertically spaced sets of hook members may be used on the hinge side of the casement window assembly 10 between the vertical outer frame member 12 and the vertical sash frame member 32, depending on the height of the window assembly and the possible wind force.

Figure 6:
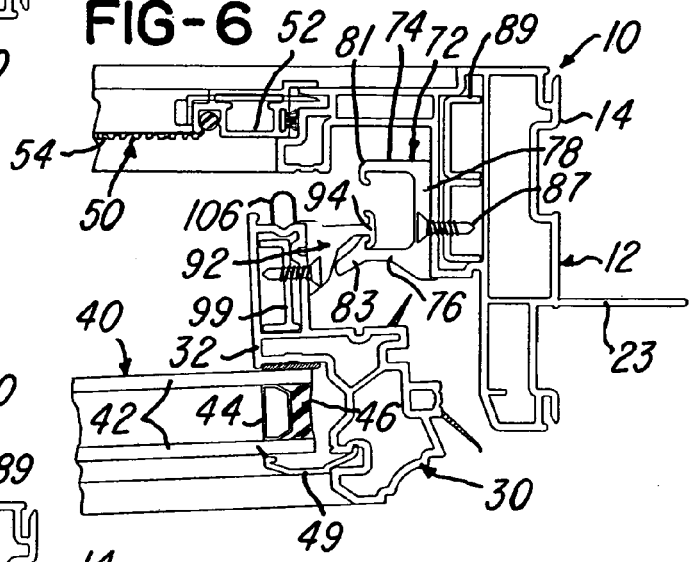
FIG. 6 is a fragmentary section similar to FIG. 2 and showing the closed window assembly under a high negative pressure on the sash frame and window panel.
Figure 7:
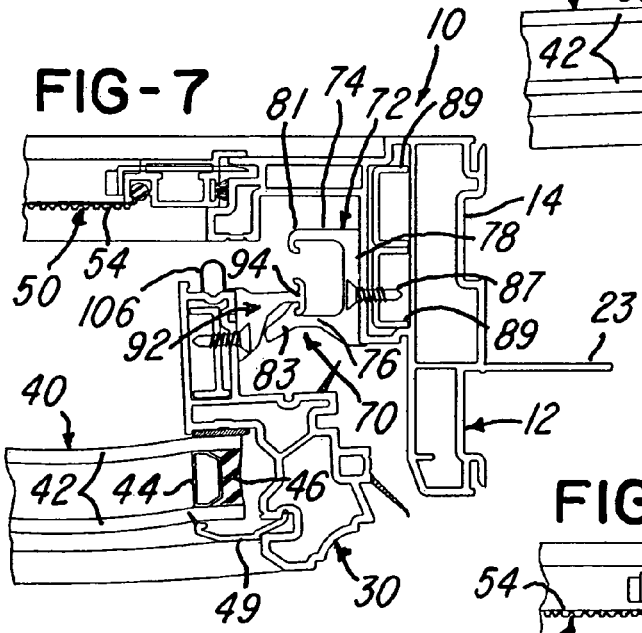
FIG. 7 is a fragmentary section similar to FIG. 6 and showing the deflection of the sash frame and window panel under a substantially higher negative pressure.

FIGS. 6&7 illustrate the interlocking of the hook members 72 and 92 in response to substantial negative pressure due to suction on the sash frame 30 and the glass panel unit 40 carried by the sash frame and when the window assembly is in its closed position. For example, FIG. 6 illustrates a negative pressure or suction on the sash frame 30 and glass unit 40 and when the sash frame members 32 tend to move laterally inwardly towards each other and away from the outer frame 12. In this condition, one side of the hook portion 94 of the hook member 92 engages and interlocks with the hook portion 83 of the hook member 72. As a result, the sash frame 30 and glass unit 40 remain substantially intact and rigidly connected to the outer main frame 12 due to the lock 62 on one side of the window assembly and the hook members on the other side of the assembly. Similarly, FIG. 7 illustrates the glass unit 40 and sash frame 30 under a higher negative pressure such as may occur during a hurricane and after the glass unit 40 breaks but still remains with the sash frame 30 which remains interconnecting with the main outer frame 12.

Figure 8:
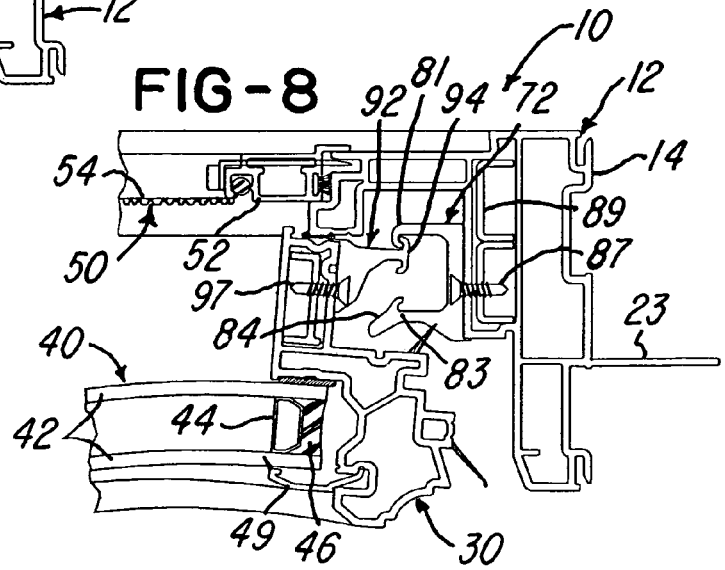
FIG. 8 is a fragmentary section of the closed window assembly and showing the deflected sash frame and glass window panel under a substantially high positive pressure after an impact broke the window panel.

FIG. 8 illustrates a high positive pressure due to a high windload after an impact such as occurs during a hurricane and wherein the other side of the hook tip portion 94 of the hook member 92 engages and interlocks with the hook tip potion 81 of the hook member 72. In this condition, the glass unit 40 has broken, but the interlocking of the hook members 72 and 92 locks the sash frame 30 to the outer main frame 12 and prevents the sash frame and window unit from being separated from the outer frame 12. As mentioned above, in order to prevent the glass unit from shattering and pieces of glass flying loosely, the glass unit may incorporate an inner sandwiched layer of PVB material which is well known in the assembly of insulated glass units.

From the drawings and the above description, it is apparent that a casement window assembly incorporating hook members 72 and 92 secure to the corresponding vertical frame members 14 and 32, respectively, provides desirable advantages. For example, the hook members provide for interlocking of the hinge side of the sash frame to the main support frame during high negative or positive windloads or due to such windloads after an impact from a flying object and thereby limit deflection of the sash frame and prevent permanent deformation of the sash frame. In addition, the hook members remain engaged or interconnected until the high wind forces are removed when the sash frame returns to its normal position, as shown in FIG. 2. In the event the insulated glass unit breaks during a high hurricane windload or impact, the glass unit remains with the sash frame and the sash frame remains interlocked with the outer main frame. Furthermore, the hook members 72 and 92 are effective to produce a snubbing action to assure a uniform compression of the resilient seal 106.

While the form of casement window assembly herein described constitutes a preferred embodiment of the invention, it is to be understood that the invention is not limited to this precise form of assembly, and that changes may be made therein without departing from the scope and spirit of the invention as defined in the appended claims.

What is claimed is:

1. A casement window assembly comprising a main support frame for installing within a window opening of a building structure, a sash frame supported for swinging and horizontal movement on a vertical pivot axis by said main support frame between a closed position disposed within said main support frame and an open position projecting outwardly from said main support frame, an insulated glass panel unit mounted within said sash frame, a metal extrusion section comprising a metal hook member having a base portion rigidly secured to a vertical frame member of said sash frame by fasteners for movement with said sash frame to said open position and including a vertically extending T-shape tip portion integral with said base portion, said tip portion having J-shape hook portions projecting horizontally in opposite directions from said tip portion, a metal extrusion section comprising a metal hook channel having a base portion rigidly secured to a vertical frame member of said main support frame by fasteners and including horizontally spaced and vertically extending inner and outer vertical legs integral with said base portion of said channel with said legs having J-shape hook portions projecting towards one another and defining a space therebetween, said metal hook member and said metal hook channel each having a vertical height substantially less than a vertical height of said sash frame and positioned only adjacent said pivot axis, a vertically extending resilient and compressible sealing member positioned between said vertical frame member of said sash frame and said vertical frame member of said main support frame, said tip portion of said hook member passes without interference through said space between said hook portions of said hook channel when said sash frame moves on said vertical pivot axis between said closed position and said open position, and one of said J-shape hook portions of said metal hook member and a corresponding one of said J-shape hook portions of said metal hook channel interlocking with each other in response to a deflection of said vertical frame member of said sash frame relative to said main support frame when said sash frame is in said closed position.

2. A window assembly as defined in claim 1 wherein said base portion of said metal hook member and said outer leg of said metal hook channel include corresponding vertically extending and opposing cam surfaces effective to engage one another and compress said resilient sealing member extending vertically between said vertical frame members in response to moving said sash frame from said open position to said closed position.

* * * * *